United States Patent [19]

Wallach

[11] 4,016,183

[45] Apr. 5, 1977

[54] BEAD WITH A PROJECTION

[76] Inventor: Alfred H. Wallach, c/o Walbead Inc., 38 W. 37th St., New York, N.Y. 10018

[22] Filed: Apr. 17, 1972

[21] Appl. No.: 244,412

[52] U.S. Cl. ..... 428/542; 29/433; 35/15; 35/27; 46/16; 46/17; 46/23; 63/DIG. 3; 156/63

[51] Int. Cl.[2] ..... B32B 9/04

[58] Field of Search ..... 29/433; 35/15, 27; 46/16, 17, 23; 63/DIG. 3; 161/7, 36, 39, 48, 49, 109, 112, 37, 38; 156/63; 428/542

[56] References Cited

UNITED STATES PATENTS

| | | | |
|---|---|---|---|
| 1,329,850 | 2/1920 | Pye | 35/27 |
| 1,423,566 | 7/1922 | King | 46/22 |
| 2,149,363 | 3/1939 | Rivkin | 40/28 |
| 2,573,087 | 10/1951 | Youngblood et al. | 161/39 |
| 3,274,727 | 9/1966 | Zander | 46/16 |
| 3,503,832 | 3/1970 | Umminger, Jr. | 156/63 |
| 3,545,069 | 12/1970 | Krieger | 29/433 |
| 3,587,160 | 6/1971 | Raickle | 29/433 |

FOREIGN PATENTS OR APPLICATIONS

| | | | |
|---|---|---|---|
| 217,352 | 1/1958 | Australia | 63/DIG. 3 |
| 734,659 | 5/1966 | Canada | 35/27 |
| 882,948 | 11/1961 | United Kingdom | 63/DIG. 3 |
| 597,762 | 2/1948 | United Kingdom | 35/18 |

*Primary Examiner*—Marion E. McCamish
*Attorney, Agent, or Firm*—John M. Montstream

[57] ABSTRACT

A bead and a bead item is disclosed in which the bead has a projection extending therefrom having a dimension so that it can be pushed into a hole or groove in a grid and retained therein to make a bead design. The grid can be used in two ways in that it can serve as a permanent part of the bead structure or item after the design of beads has been built thereon or after the design has been completed the beads may be laced together with thread, wire, dowels and the like after which the bead projections are broken away at the bead body leaving the bead design without the grid. The projection may have a knob on the end thereof which is pressed into the hole or groove in the grid to more securely retain the bead on the grid. The beads may be of many different sizes and shapes. The grid may be thin or flexible enough so that it can be bent in forming a permanent part of the bead item. The grid can form a permanent backing such as for framing the bead design and other uses. A new method of making a bead item is also disclosed.

6 Claims, 10 Drawing Figures

BEAD WITH A PROJECTION

The bead to be described provides an improved method of making bead designs and items. The designs can be quickly assembled on a perforated or grooved grid and the design can be changed with ease should it be desired to change one or more beads for another bead or beads of a different color, shape and the like. After the design has been created, or followed from a previously provided instruction sheet, the beads may be secured together by threading, wiring, doweling or the like, and separated from the grid by breaking off the projections. The beads may remain on the grid to form a part of the bead item.

The principle object of the invention is to provide a bead with a projection which is insertable and retained in a grid having receiving means in the form of holes or grooves so that any bead or beads may be changed at any time to change the design of the bead item.

Another object is as above but the projection is one which is easily broken off to separate the bead from the grid, if desired, on completion of the bead item.

Another object is as in the principle object but the projection is relatively unbreakable so that a bead item is made which includes the grid.

Another object is to provide an enlargment or knob on the end of the projection so that the bead is retained on the grid and not inadvertently dislodged.

A further object is to make the bead in oval or general rectangular form so that the beads assembled on the grid remain with their bead holes in alignment.

Another object is to use a flexible grid so that it may be a part of the bead item which can be bent into circular form, such as for a bracelet, or bent into other forms for other purposes.

A still further object is to provide beads of various forms and constructions for increasing the variety of designs and purposes.

Another object is to provide a bead which has a hole therethrough large enough with respect to the holes in in the grid so that beads in adjacent rows are in stagger relation with their bead holes overlapping whereby the connecting thread, wire or dowel is projected through the hole in the beads of the next row thereby interlocking the rows of beads together.

A further object is to provide a bead which spans two rows of perforations in an assembling grid and has two projections and at least two bead holes therethrough spaced apart the same distance as the rows of grid holes or perforations so that adjacent rows of beads are interlocked together.

Another object is to provide a new method of making a bead item.

Other objects of the invention will be more apparent from the following description when taken in connection with the accompanying drawing illustrating preferred embodiments thereof in which.

The present method of making bead items or designs is to string threads longitudinally on a bead loom and then interweave beads across the longitudinal threads by projecting a thread through the hole in the bead and interlacing this thread with the longitudinal threads on the loom. Once the design has been woven it is impossible to make any changes therein except by tearing down the design to the point of change and starting over again. The construction herein using a bead with a projection which is projected into a receiving means, such as a hole or groove in a receiving grid enables any one or more beads to be easily removed and replaced at any time as desired.

Figure 1:
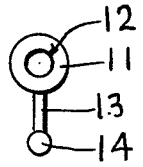
FIG. 1 is an enlarged front view of the bead.
Figure 2:
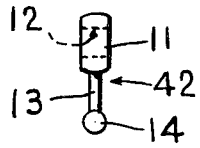
FIG. 2 is a side view of the bead of FIG. 1.
Figure 9:
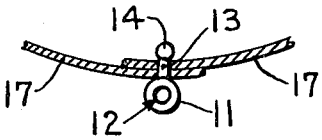
FIG. 9 illustrates the ends of a grid secured together by beads for circular items.

The bead of FIGS. 1 and 2 is customary bead size but is enlarged for illustration. It includes a bead body 11 with its bead hole 12 for threading, wiring or doweling. A slender projection 13 extends from the outer periphery and at right angles to the bead hole 12. Preferably the end of the projection carries a knob or enlargment 14. The bead body desirably approximates an oval or generally rectangular form and is narrower than its diameter or longitudinal dimension so that when the bead is assembled on the grid the beads will not turn but will remain with their bead holes in alignment for threading, wiring or doweling when the design is completed. The material of the bead in one form is one which is weak enough so that the projection can be broken off relatively easily, however, it should not be so weak that inadvertent breaking occurs too frequently. Preferably the projection is long enough so that it can receive overlapping ends or edges of a grid or grids for making circular or oval bead items, FIG. 9, or to enlarge the grid by attaching two or more grids together by inserting bead projections in aligned holes at overlapping edges. Plastic provides a suitable material for the beads.

The grid 17 is a sheet, such as of plastic, with a plurality of spaced rows 18 of receiving means, such as holes 19 or grooves 20, to receive the bead projection. The grid has preferably some elasticity so that the projection can be pressed into a hole or groove in the grid, or with a projection having a knob 14 which can be pressed into a hole or groove and remain in place against inadvertent removal. The holes in the grid are in spaced rows with the holes in each row spaced apart slightly more than the width of the bead and the rows are spaced apart slightly more than the diameter or longitudinal dimension of the bead. When a knob is provided on the projection, the grid receiving means are a little smaller than the size of the knob so that it must be pressed thereinto. It is clear that the grid may be of inflexible material in which case the bead material must have enough elasticity for the knob to be pressed into the receiving means. The grid and bead jointly may have the flexibility required so that the knob can be pressed into the receiving means.

Figure 3:
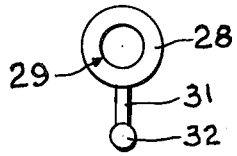
FIG. 3 is an enlarged front view of a bead having a large bead hole therethrough for interlocking adjacent rows of beads.
Figure 4:
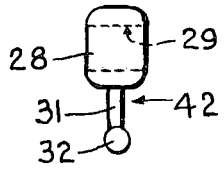
FIG. 4 is a side view of the bead of FIG. 3.
Figure 8:
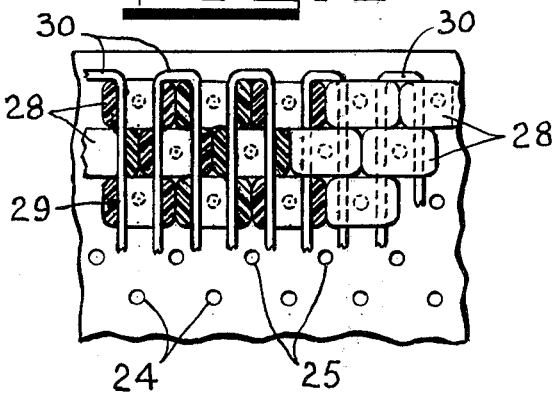
FIG. 8 shows a design of beads using the bead of FIGS. 3 and 4 with some beads in section.

FIGS. 3 and 4 illustrate a bead having a bead body 28 of larger diameter or longitudinal dimension so that it has a dimension of two rows of receiving means or perforations 24 and 25 in a grid 23 and can be assembled in staggered relation as shown in FIG. 8. The bead holes 29 are large enough so that the bead holes in adjacent staggered beads overlap and the connecting means, such as thread, wire or dowel 30, passing through the holes of adjacent beads interlink or interlock the same together. This bead has a projection 31 preferably with an end knob 32.

Figure 7:
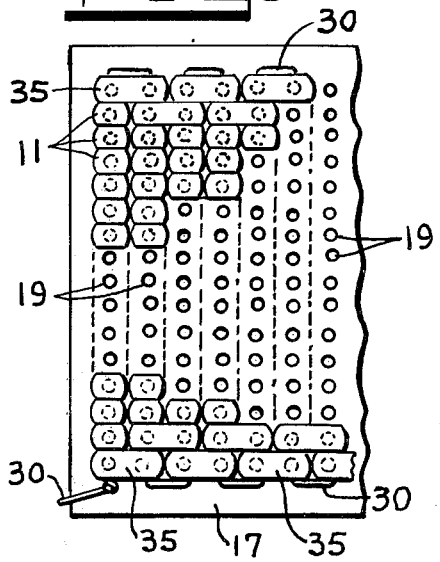
FIG. 7 shows a partial design of beads using the bead of FIG. 5.
Figure 5:
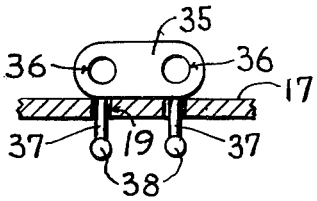
FIG. 5 is an enlarged view of a bead with two spaced bead holes therethrough and with spaced projections.

FIG. 5 shows a bead which performs an interlocking function in that the bead body 35 has a longitudinal dimension to span two rows of perforations or grid holes 19 and has spaced bead holes 36 which are in alignment with the bead holes in adjacent rows of beads. The bead holes may be defined also as space apart corresponding with the space between adjacent rows of holes in the grid. This bead has two spaced projections 37 preferably with knobs 38 on the end thereof. The projections are spaced apart a distance to be inserted in adjacent rows of grid receiveing means 19. When the beads are laced together with thread 30, this bead ties or interlocks adjacent rows of beads together at the edges of the bead item as shown in FIG. 7 or may be in a central region of the bead item or both. It also provides a bead with a different appearance to vary the design.

Figure 6:
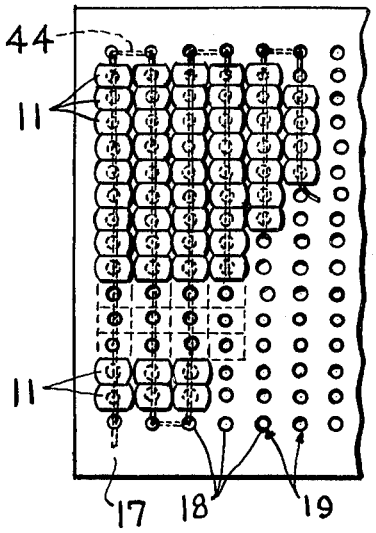
FIG. 6 is a view showing a partial design of beads on a perforated grid.
Figure 10:
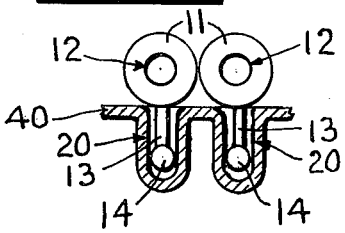
FIG. 10 shows a grid having securing grooves.

The grids illustrated in FIGS. 6, 7 and 8 have holes to receive the projection on each bead and retain the beads thereon, when the design is being constructed. FIG. 10 shows a grid 40 in which grooves 20 provide the receiving means or aperture for the projections when the bead item is being constructed. The material of this grid preferably is elastic and the groove has a width so that the groove grips the projection or its knob against inadvertent removal.

The grid illustrated in FIG. 8 shows the holes in the grid as having rows of holes 24 or 25 in alignment but with the holes 25 in the next row being being staggered with respect to of the adjacent row. The grid of FIG. 6 is suitable use with the bead of FIG. 3 in overlapping arrangement, it just means that alternate rows of holes are used for alternate beads and if the bead is wide as illustrated alternate columns of holes are used.

It may be desirable to have a weakening nick 42 in the projection at the bead body to make it easier to break off the projection when it is desired to separate the design from the grid. If the grid is to be a permanent part of the bead item adhesive may be applied to the back of the grid to permanently anchor the projection and the beads to the grid. With the perforated grid a picture scene or the like can be pasted or otherwise secured to the back of the grid and the colors show through the holes thereby providing a color guide in the reproduction of the picture or scene in a bead design. The bead with a projection and rows of receiving means carried by a grid provides a new method of constructing a bead item which may be separated from the grid by breaking off the projections or may be a combination of the beads and the grid.

In constructing a bead item, means are used to secure the beads in assembled relation. This securing means may be the thread, wire or dowel which is threaded through the holes of the rows of beads in known manner and which may include a border or frame members at the edges of the design. The securing means may be the grid with the thread or wire 44 interlaced at the end of each row of beads with the grid as shown in FIG. 6.

This invention is presented to fill a need for improvements in a Bead with a Projection, a Bead Item and a Method of making the Item. It is understood that various modifications in structure, as well as changes in mode of operation, assembly, and manner of use, may and often do occur to those skilled in the art, especially after benefiting from the teachings of an invention. The disclosure illustrates the preferred means of embodying the invention in useful form.

What is claimed is:

1. A bead for use with a grid having thickness and spaced rows of receiving apertures spaced apart equal to the width of the bead comprising a bead body having having at least one bead hole therethrough and an external surface, at least one projection integral with the bead body and extending from the exterior surface thereof and at right angles to the bead hole, the bead body having a longitudinal dimension equal to the spacing between the rows of receiving apertures in the grid, and the projection having a length at least equal to the thickness of the grid, and a knob on the end of the projection having a dimension related solely to and being larger than the receiving aperture in the grid such that it yieldably resists insertion in a receiving aperture in the grid so as to be retained therein, the bead body having a width greater than the dimension of knob, and the material of the bead and the dimension of the projection at the bead body renders the projection readily breakable therefrom.

2. A bead as in claim 1 in which the bead body is narrower than its longitudinal dimension so as to assure alignment of the bead hole with the bead hole of an adjacent bead.

3. A bead as in claim 1 in which the material of the bead and of the knob is compressible enabling the knob to be pressed into a receiving aperture which is slightly smaller than the knob.

4. A bead as in claim 1 in which the bead body has a longitudinal dimension equal to the spacing between two rows of receiving apertures in the grid, and the bead hole has a dimension such that the bead holes of adjacent beads when assembled on the grid in staggered relation overlap each other.

5. A bead as in claim 1 in which the projection has a length at least twice the thickness of the grid.

6. A bead as in claim 1 in which the bead body spans two rows of receiving apertures in the grid, a pair of bead holes through the bead body spaced apart a distance equal to the span between two rows of receiving apertures, and a pair of projections extending from the exterior surface of the bead body and spaced apart equal to the spacing between adjacent rows of receiving apertures.

* * * * *